US006757995B2

(12) United States Patent
Pippins

(10) Patent No.: US 6,757,995 B2
(45) Date of Patent: Jul. 6, 2004

(54) SYSTEM AND METHOD FOR COUPLING EXCAVATION EQUIPMENT COMPONENTS

(75) Inventor: Sherlock K. Pippins, Dallas, TX (US)

(73) Assignee: TRN Business Trust, Dallas, TX (US)

( * ) Notice: Subject to any disclaimer, the term of this patent is extended or adjusted under 35 U.S.C. 154(b) by 12 days.

(21) Appl. No.: 10/194,017

(22) Filed: Jul. 12, 2002

(65) Prior Publication Data

US 2004/0016153 A1 Jan. 29, 2004

(51) Int. Cl.[7] ..... E02F 3/96; E02F 9/28

(52) U.S. Cl. ..... 37/468; 37/450; 37/457; 172/683; 172/713; 172/719; 172/750; 172/753; 172/772.5

(58) Field of Search ..... 37/468, 403, 446, 37/450, 451–459, 903; 172/772, 772.5, 753, 749–751, 719, 705–708, 683, 681, 713

(56) References Cited

U.S. PATENT DOCUMENTS

| | | | | |
|---|---|---|---|---|
| 1,216,290 | A | 2/1917 | Dickson | |
| 1,419,047 | A | 6/1922 | Hanks et al. | |
| 1,845,677 | A | 2/1932 | Mekeel | |
| 2,064,059 | A | 12/1936 | Fellmeth | 37/142 |
| 2,113,420 | A | 4/1938 | Younie | 37/141 |
| 2,618,873 | A | 11/1952 | Hostetter | 37/142 |
| 2,635,366 | A | 4/1953 | Hostetter | 37/142 |
| 2,689,419 | A | 9/1954 | Daniels et al. | 37/142 |
| 2,934,842 | A | 5/1960 | Buskirk | 37/142 |
| 3,027,201 | A | 3/1962 | Blazek et al. | |
| 3,068,737 | A | 12/1962 | Mewse | |
| 3,498,677 | A | 3/1970 | Morrow | 299/86 |
| 3,787,132 | A | 1/1974 | Garnett | 403/290 |
| 3,831,298 | A | 8/1974 | Helton et al. | |
| 3,839,805 | A | 10/1974 | Stepe | 37/142 |
| 3,879,867 | A | 4/1975 | Ericson et al. | 37/142 A |
| 3,896,569 | A | 7/1975 | Thompson et al. | 37/141 |
| 3,967,399 | A | 7/1976 | Heinold et al. | 37/142 |
| 3,974,579 | A | 8/1976 | Black et al. | 37/141 |

(List continued on next page.)

FOREIGN PATENT DOCUMENTS

| | | |
|---|---|---|
| AU | 199911346 A1 | 7/2000 |
| AU | 200154094 A1 | 1/2002 |
| CA | 2161505 | 4/1997 |
| EP | 0 717 204 A1 | 6/1996 |
| GB | 303708 | 1/1929 |
| GB | 364531 | 12/1931 |
| GB | 836167 | 6/1960 |

OTHER PUBLICATIONS

"Dragline Products—Hensley Style" (eleven pages), Date Unknown.
"Keech Castings Australia PTY. Limited," Aug. 31, 1995 (one page), Date Unknown.
"Maglok® System," *Quality Steel Foundries Ltd*, Date Unknown.
"Mining Vertalok® Adapters for Shovel Dippers," ©1992 ESCO Corporation. (4 pages).
"Posilok® Tooth Systems" (one page), Date Unknown.
"Torqlok ® System," *Quality Steel Foundries Ltd.* (one page) Date Unknown.

*Primary Examiner*—Christopher J. Novosad
(74) *Attorney, Agent, or Firm*—Baker Botts L.L.P.

(57) ABSTRACT

A system for coupling excavation equipment components is provided. The system includes a retainer pin having first and second detents which are extendable axially from a surface of the retainer pin, in response to rotation of a valve seated at least partially within a cylindrical bore which extends at least partially through the retainer pin. In accordance with the particular embodiment, the valve includes at least one slotted portion configured to receive the detents at least partially therein, when the detents are in a retracted position.

12 Claims, 4 Drawing Sheets

U.S. PATENT DOCUMENTS 3,982,339 A 9/1976 Nilsson ..... 37/141
4,067,657 A 1/1978 Kaarlela ..... 403/317
4,120,105 A 10/1978 Stepe ..... 37/142 R
4,233,761 A 11/1980 Ryerson ..... 37/142
4,247,147 A 1/1981 Rettkowski ..... 299/10
4,271,615 A 6/1981 Jones
4,326,348 A 4/1982 Emrich ..... 37/142
4,335,532 A 6/1982 Hahn et al. ..... 37/142
4,404,760 A 9/1983 Hahn et al. ..... 37/142
4,414,764 A 11/1983 Johansson et al. ..... 37/141 T
4,433,496 A 2/1984 Jones et al.
4,446,638 A 5/1984 Novotny et al. ..... 37/142 A
4,481,728 A 11/1984 Mulder et al. ..... 37/142
4,587,751 A 5/1986 Sjogren et al. ..... 37/142
4,662,762 A 5/1987 Schwartz ..... 384/25
4,663,867 A 5/1987 Hahn et al. ..... 37/142
4,716,667 A 1/1988 Martin ..... 37/142
4,727,663 A 3/1988 Hahn ..... 37/142
4,782,607 A 11/1988 Frisbee et al. ..... 37/141 T
4,823,487 A 4/1989 Robinson ..... 37/142
RE33,042 E 9/1989 Emrich ..... 37/142
4,895,459 A 1/1990 Werner ..... 384/43
4,932,145 A 6/1990 Reeves, Jr. ..... 37/141 T
4,941,758 A 7/1990 Osawa ..... 384/40
5,009,017 A 4/1991 Diekevers et al. ..... 37/142
5,074,062 A 12/1991 Hahn et al. ..... 37/142
5,081,774 A 1/1992 Kuwano ..... 137/142
5,088,214 A 2/1992 Jones ..... 37/141
5,111,600 A 5/1992 Lukavich et al. ..... 37/141
5,152,088 A 10/1992 Hahn ..... 37/142
5,172,501 A 12/1992 Pippins ..... 37/142
5,181,780 A 1/1993 Morita ..... 384/8
5,233,770 A 8/1993 Robinson ..... 37/456
5,263,351 A 11/1993 Berg, III ..... 72/208
5,297,873 A 3/1994 Komiya ..... 384/45
5,337,495 A 8/1994 Pippins ..... 37/453
5,361,520 A 11/1994 Robinson ..... 37/458
5,410,826 A 5/1995 Immel et al. ..... 37/457
5,423,138 A 6/1995 Livesay et al. ..... 37/456
5,435,084 A 7/1995 Immel ..... 37/398
5,452,529 A 9/1995 Neuenfeldt et al. ..... 37/455
5,469,648 A 11/1995 Jones et al. ..... 37/457
5,484,210 A 1/1996 Gallone ..... 384/49
5,491,915 A 2/1996 Robinson ..... 37/458
5,638,621 A 6/1997 Keech et al. ..... 37/446
5,709,043 A 1/1998 Jones et al. ..... 37/458
5,802,795 A 9/1998 Myers et al. ..... 52/426
5,926,982 A 7/1999 Keech et al. ..... 37/455
5,937,550 A 8/1999 Emrich ..... 37/458
5,947,209 A 9/1999 Halford et al. ..... 172/772
5,983,534 A 11/1999 Robinson et al. ..... 37/459
5,992,063 A 11/1999 Mack ..... 37/450
6,000,153 A 12/1999 Sollami ..... 37/453
6,013,078 A 1/2000 Lin ..... 606/72
6,018,896 A 2/2000 Adamic ..... 37/456
6,052,927 A 4/2000 Pippins ..... 37/454
6,092,958 A 7/2000 Gale ..... 403/378
6,108,950 A 8/2000 Ruvang et al. ..... 37/452
6,119,378 A 9/2000 Pippins ..... 37/454
6,151,812 A 11/2000 Bierwith ..... 37/455
6,247,255 B1 6/2001 Clendenning ..... 37/452
6,301,810 B1 10/2001 Fidler ..... 37/458
6,374,521 B1 4/2002 Pippins ..... 37/456
2002/0000053 A1 1/2002 Adamic et al. ..... 37/456
2002/0010994 A1 1/2002 Hess ..... 29/426.5
2002/0023375 A1 2/2002 Pippins ..... 37/457

SYSTEM AND METHOD FOR COUPLING EXCAVATION EQUIPMENT COMPONENTS

TECHNICAL FIELD OF THE INVENTION

The present invention relates generally to replaceable excavation equipment components that are exposed to high wear and repeated shock loading such as removable teeth and adapter assemblies used on excavating machines, and more particularly, to a system and method for coupling excavation equipment components.

BACKGROUND OF THE INVENTION

Digging and leveling apparatus such as drag lines, back hoes, front-end loaders, bulldozers, and the like often use replaceable teeth and adapter assemblies which are mounted on a tooth horn to provide sacrificial parts that are exposed to the repeated shock loading and high wear occasioned by digging operations. In such systems, adapter assemblies may include a wedge-shaped adapter which mounts directly on the tooth horn of a bucket, shovel or alternative digging or scraping mechanism of the equipment. The wedge-shaped adapter is frontally seated on and coupled with the tooth horn for receiving a removable tooth. A removable retainer pin may be used to couple the adapter and a removable tooth.

SUMMARY OF THE INVENTION

The present invention includes a system and method for coupling excavation equipment components that substantially eliminates or reduces disadvantages or problems associated with previously developed fastening methods and apparatus. In particular, the present invention provides a system and method for coupling a removable tooth with an adapter assembly, using a retainer pin. A valve disposed within the retainer pin maintains a pair of detents extending from the retainer pin in an extended position, which prevents movement of the tooth and the retainer pin, with respect to the adapter. The valve may be rotated to a second position which allows for retraction of the detents, and decoupling of the adapter and the tooth.

In accordance with a particular embodiment of the present invention, a system for coupling excavation equipment components includes an elongate, retainer pin body. The body defines a cylindrical bore which extends at least partially through the retainer pin body. An elongate, generally cylindrical valve which is configured to be received at least partially within the cylindrical bore, is also provided. At least one detent extends at least partially through a slot in the retainer pin body, the slot being generally perpendicular to the cylindrical bore and extending from the cylindrical bore to an outer surface of the retainer pin body. In accordance with a particular embodiment of the present invention, the valve includes a first position in which the valve contacts the detent and the detent extends beyond the outer surface of the retainer pin body, and a second position in which the detent is retracted with respect to the first position.

In accordance with another embodiment of the present invention, the system includes an adapter having first and second tapered surfaces, and first and second sides, the first and second tapered surfaces converge toward a first end of the adapter. The adapter defines an internal bore which extends from the first side of the adapter and at last partially through the adapter. The internal bore may be configured to receive the retainer pin body, at least partially therein. In accordance with this embodiment, the at least one detent is operable to couple the adapter and the retainer pin body, and prevent movement of the retainer pin body with respect to the adapter when the valve is in the first position.

Technical advantages of particular embodiments of the present invention include a system and method for securely coupling a removable tooth with an adapter using a retainer pin. The retainer pin is prevented from lateral movement with respect to the adapter, which prevents inadvertent decoupling of the removable tooth and the adapter.

Another technical advantage of particular aspects of the present invention includes a system and method for coupling a removable tooth with an adapter such that the removable tooth and the adapter may be easily decoupled in the field by an operator. The decoupling of the removable tooth from the adapter may be accomplished by using simple hand and/or power tools.

Other technical advantages will be readily apparent to one skilled in the art from the following figures, descriptions, and claims. Moreover, while specific advantages have been enumerated above, various embodiments may include all, some or none of the enumerated advantages.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF THE INVENTION

Figure 1:
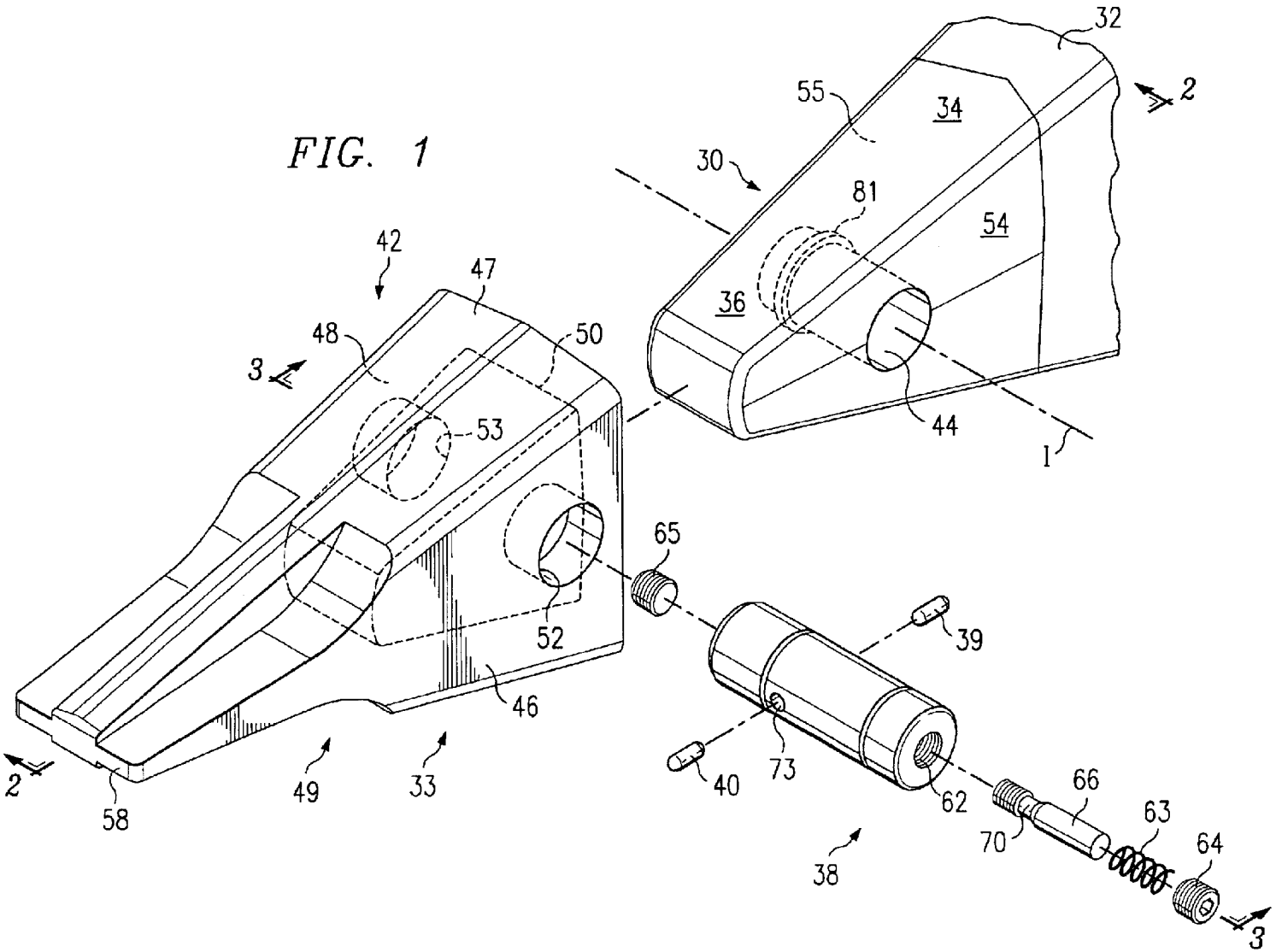
FIG. 1 is an isometric exploded view of an adapter and removable tooth which may be coupled using a retainer pin according to a particular embodiment of the present invention.
Figure 2:
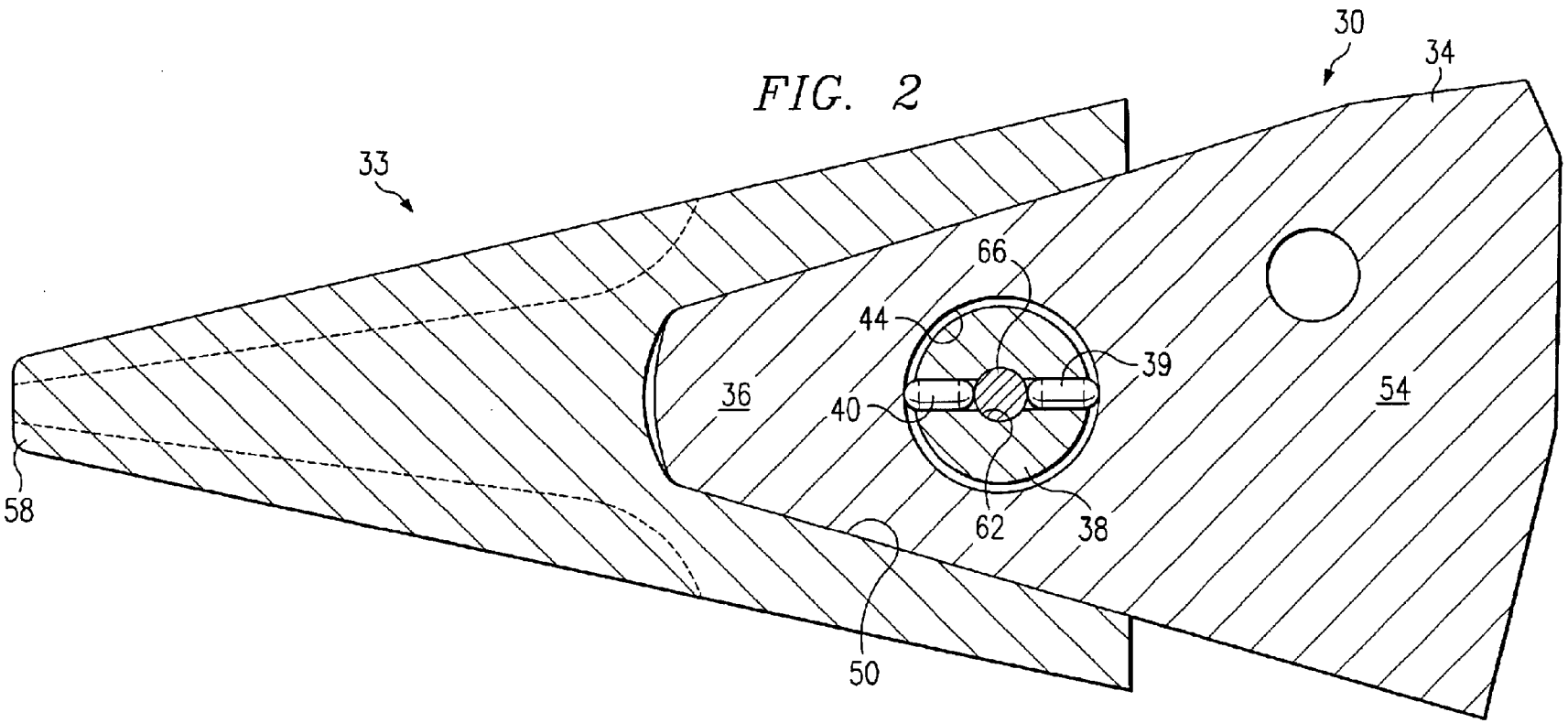
FIG. 2 is a cross-sectional view of the removable tooth and adapter assembly of FIG. 1, in a coupled position.
Figure 3:
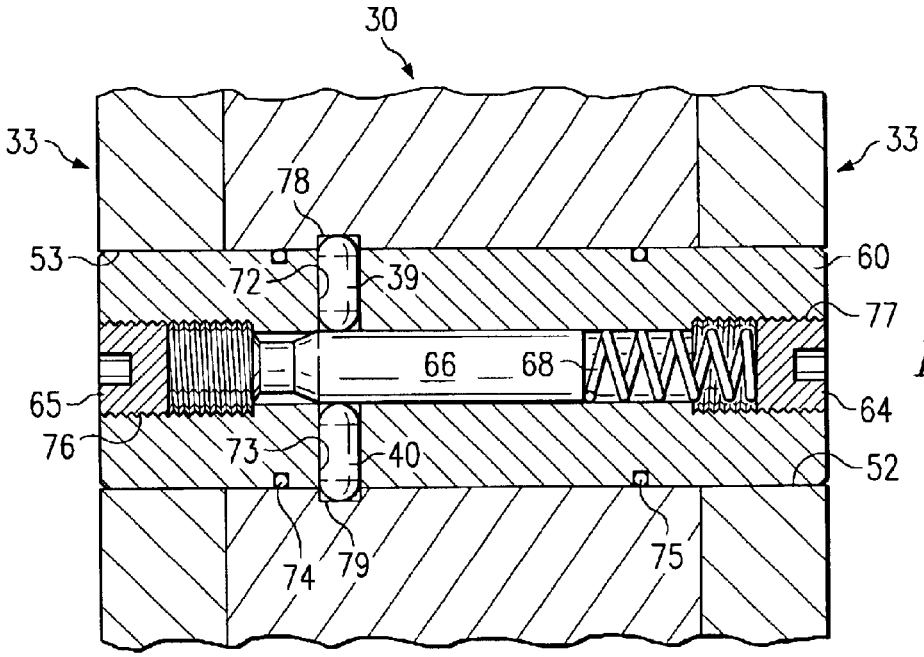
FIG. 3 is a cross-sectional view, with portions broken away, illustrating the removable tooth, adapter assembly, and retainer pin in their coupled position.

FIGS. 1–3 illustrate an adapter 30 that may be removably coupled with a tooth horn 32 of a bucket, shovel or other part of an excavating machine or excavation equipment component. Accordingly, adapter 30 includes a first end 34 configured to receive tooth horn 32 at least partially therein. A second end 36 of adapter 30 is configured to receive a removable tooth 33 thereon. A retainer pin 38 secures removable tooth 33 in place upon adapter 30. In the installed position, a pair of detents 39, 40 extend from retainer pin 38 and cooperate with adapter 30 to prevent lateral movement of retainer pin 38 along an imaginary longitudinal central axis of retainer pin 38, and to prevent decoupling of removable tooth 33 and adapter 30. Detents 39 and 40 may be retracted from engagement with adapter 30 to allow the removal of retainer pin 38 from adapter 30. After retainer pin 38 is removed from adapter 30, removable tooth 33 and adapter 30 may be decoupled. Detents 39 and 40 may be extended and/or retracted to/from engagement with adapter 30 by hand, and/or using simple hand tools.

Retainer pin 38 and detents 39 and 40 cooperate to provide for the simplified installation and/or removal of removable tooth 33 from adapter 30. Such removable teeth may be installed, removed or replaced by an operator in the field, quickly and easily. The configuration of adapter assembly 30, retainer pin 38 and detents 39 and 40 prevent shifting of retainer pin 38, and removable tooth 33, with respect to adapter 30, during use.

Removable tooth 33 is subject to significant wear and tear during excavation and/or mining operations. Extreme shock loading is experienced as removable tooth 33 impacts adjacent earth, rocks, and other abrasive material. Therefore, it is desirable to make removable tooth 33 readily replaceable with a new or reconditioned tooth of similar or identical configuration. Otherwise, adapter 30, or buckets, shovels or other excavation equipment would need to be replaced more frequently, increasing equipment and labor costs associated therewith. By providing a removable tooth 33 at a location upon adapter 30 that would otherwise experience the most wear, the service life of such equipment is prolonged by replacing selected parts associated with the excavation equipment.

In order to prevent excessive wear of adapter 30 and/or tooth horn 32, for example, removable tooth 33 is coupled with and at least partially conceals and/or protects adapter 30 from abrasive materials during excavation. Removable tooth 33 includes a rigid tapered body portion 42. Tapered body portion 42 generally includes four sides 46–49, which cooperate to define a recess 50 at first end 34. Recess 50 is configured to receive adapter 30 at least partially therein. Sides 46 and 48 are spaced from one another at a first adapter end 34. Sides 46 and 48 are tapered, and converge at a second end 36.

Sides 46 and 48 include respective openings 52 and 53, which are configured to receive retainer pin 38 at least partially therethrough. Openings 52 and 53 are generally aligned with one another, such that retainer pin 38 may extend at least partially through each of openings 52 and 53, while removable tooth 33 is in an installed position. The respective positions of opening 52 and 53 upon sides 46 and 48, respectively, are selected to align with an internal bore 44 that extends from a first side 54 of adapter 30 to a second side 55 of adapter 30. In other words, when removable tooth 33 is properly positioned upon adapter 30, internal bore 44, and openings 52 and 53 are aligned such that an imaginary central longitudinal axis I through internal bore 44 extends through opening 52 and 53. This allows retainer pin 38 to extend from internal bore 44 at least partially into each of openings 52 and 53, while retainer pin 38 is in the installed position.

The configuration of tapered body portion 42 may vary significantly within the teachings of the present invention. For example, although sides 46 and 48 are each tapered and sides 47 and 49 are generally parallel with one another, other embodiments may include only one tapered side. Alternatively, more than two of sides 46–49 may be tapered, within the teachings of the present invention. Furthermore, tapered body portion 42 may include more than four sides in various embodiments. In general, the configuration of removable tooth 33 and tapered body portion 42 are selected to receive and provide protection to second end 36 of adapter 30, and to provide a material engaging surface 58 to removable tooth 33.

Retainer pin 38 includes an elongate retainer pin body 60 which defines a cylindrical bore 62 which extends through retainer pin body 60. First and second threaded plugs 64 and 65 are disposed within cylindrical bore 62 at opposite ends of cylindrical bore 62. Plugs 64 and 65 seal cylindrical bore 62 and protect it from ambient environment, fluids and debris that may be encountered during use. In the illustrated embodiment, cylindrical bore 62 extends all the way through retainer pin body 60, and two plugs are used. However, in an alternative embodiment, cylindrical bore 62 may be permanently sealed at one end, rather than employing a threadably removable plug (e.g., plug 64). Furthermore, the plug at the opposite end (e.g., plug 65), may be omitted entirely, within the teachings of the present invention.

An elongate, generally cylindrical valve 66 is disposed within cylindrical bore 62. A spring 68 is also disposed within cylindrical bore 62, between plug 64 and valve 66. Spring 68 is operable to exert a force on valve 66, to prevent inadvertent shifting of valve 66 within cylindrical bore 62. Spring 68 is held in place due to its contact with plug 64. Since plug 64 is generally fixed in place (although threadably removable) within cylindrical bore 62, spring 68 is prevented from moving beyond plug 64. In alternative embodiments, another type of biasing element (other than a spring) may be used to exert force upon valve 66. Furthermore, as discussed above, threaded plug 64 may be omitted. Instead, a permanent plug may be used in lieu of plug 64. In still another embodiment, cylindrical bore 62 may not extend all the way through retainer pin body 60, and the end of cylindrical bore 62 that is sealed by plug 64 may be permanently sealed by a portion that is integral to retainer pin body 60.

Valve 66 has a generally uniform thickness (diameter) over its entire length, except for a reduced diameter neck 70 disposed between opposing ends of valve 66. The diameter of valve 66 is configured such that detents 39 and 40 are maintained in an extended position, when detents 39 and 40 contact valve 66 at a location other than reduced diameter neck 70. Reduced diameter neck 70 is sized such that detents 39 and 40 may be at least partially received within the slot formed by reduced diameter neck 70, so that retainer pin 38 may be removed from adapter 30, in order to decouple adapter 30 and removable tooth 33.

In the illustrated embodiment, reduced diameter neck 70 comprises a circumferential groove extending along the perimeter of valve 66. However, other configurations are possible for reduced diameter neck 70. For example, reduced diameter neck 70 may include a partial circumferential groove which does not extend around the entire perimeter of valve 66. Alternatively, reduced diameter neck 70 may comprise one or more cavities extending at least partially into the surface of valve 66. Any recessed portion(s) of any size or configuration suitable to receive a detent, and prevent lateral movement of retainer pin 38, is suitable for use within the teachings of the present invention.

Detents 39 and 40 extend from cylindrical bore 62, through cavities 72 and 73, which are formed within retainer pin 38 and extend from internal bore 44. Detents 39 and 40 contact adapter 30 adjacent cavities 72 and 73, respectively, at notched openings 78 and 79 formed in adapter 30. In the illustrated embodiment, notched openings 78 and 79 are part of a cylindrical groove 81 formed on an interior surface of adapter 30 adjacent internal bore 44. Each detent also contacts valve 66, which maintains each detent 39 and 40 in place at least partially within notched openings 78 and 79, respectively. In this manner, retainer pin 38 is prevented from shifting relative to adapter 30. Furthermore, cooperation between retainer pin 38 and removable tooth 33, adjacent openings 52 and 53, prevent decoupling of removable tooth 33 and adapter 30.

Retainer pin 38 also includes a pair of circumferential grooves which are configured to receive gaskets 74 and 75. Gaskets 74 and 75 prevent dirt and/or debris from collecting adjacent detents 39 and 40, and cavities 72 and 73.

In the illustrated embodiment, cylindrical bore 62 includes threaded portions 76 and 77, at opposing ends of adapter 30. Threaded portion 77 is provided such that plug 64 may be removably coupled with retainer pin 38, and/or removed. When plug 64 is secured in place (as in FIG. 3), it provides support to spring 68. Spring 68 urges valve 66 toward plug 65, and prevents reduced diameter neck 70 from approaching detents 39 and 40. Therefore, since detents 39 and 40 contact valve 66 at the larger diameter portion (relative to reduced diameter neck 70) detents 39 and 40 are maintained in place within cavities 72 and 73.

In accordance with a particular embodiment of the present invention, plug 64 may be removed by rotating plug 64 with respect to adapter 30. In most circumstances, plug 64 is not used in decoupling retainer pin and removable tooth 33 from adapter 30. Instead, plug 64 may be used as an alternate method to remove valve 66, if plug 65 becomes jammed within adapter 30. In this embodiment, plug 65 may be outfitted with a screw head adjacent spring 68. In the illustrated embodiment, plug 64 provides access to cylindrical bore 62 to accomplish maintenance and/or replacement of spring 68, valve 66 and/or the interior of retainer pin 38.

Figure 4:
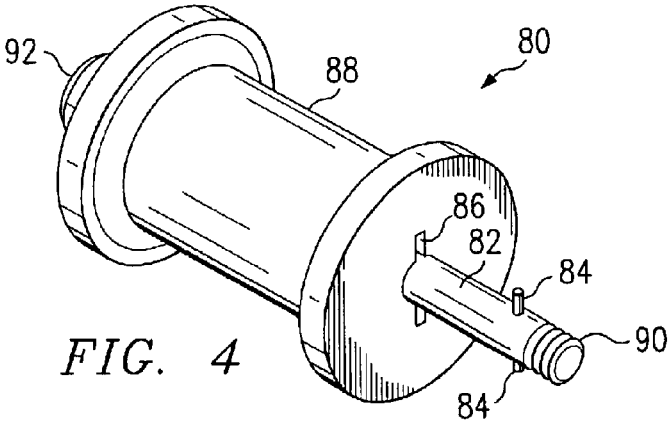
FIG. 4 is an isometric view of an extraction tool in accordance with a particular embodiment of the present invention.
Figure 5:
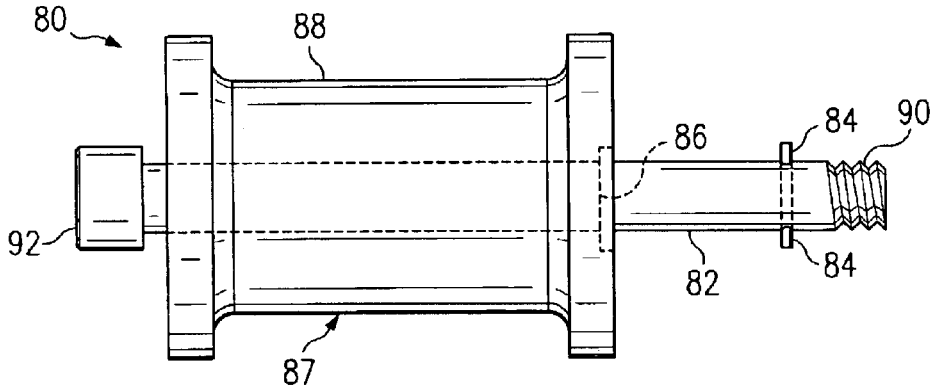
FIG. 5 is a side view of the extraction tool of FIG. 4.

In order to decouple removable tooth 33 and adapter 30, plug 65 is rotated and threadably removed from cylindrical bore 62. A removal tool, such as the tool 80 illustrated in FIGS. 4 and 5, is threadably coupled with retainer pin 38. As tool 80 is rotated with respect to retainer pin 38, valve 66 is forced toward spring 68, and spring 68 is compressed to allow such movement.

Figure 6:
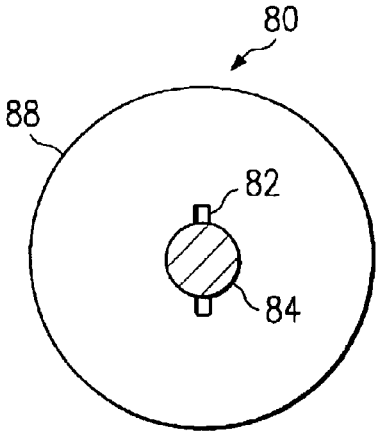
FIG. 6 is an end view of the extraction tool of FIG. 4.

FIGS. 4–6 illustrate extraction/removal tool 80 which may be used to install and/or disengage retainer pin 38 from removable tooth 33 and adapter 30. Extraction tool 80 includes a weighted member 88, which is operable to slide on an elongate body 82 of extraction tool 80. Extraction tool 80 has an enlarged end 92 and an opposite end 90 which may be threaded. Extraction tool 80 also includes locking members 84 which extend radially outward from elongate body 82. Weighted member 88 has a range of motion from enlarged end 92 to locking members 84. Weighted member 88 includes a locking recess 86, which is configured to receive locking members 84.

In accordance with a particular embodiment of the present invention, extraction tool 80 may be used to remove retainer pin 38 from removable tooth 33 and adapter 30. In order to do so, threaded end 90 of extraction tool 80 is inserted at least partially into threaded portion 76, and elongate body 82 is rotated. This causes threaded end 90 to engage threaded portion 76 of retainer pin 38 and couples extraction tool 80 with retainer pin 38.

Weighted member 88 may be used to tighten threaded end 90 within threaded portion 76. Weighted member 88 includes a gripping surface 87 suitable for an operator to grasp in order to maneuver weighted member 88 along elongate body 82. Weighted member 88 may be slid along elongate body 82 toward threaded end 90, until locking members 84 engage locking recess 86 of weighted member 88. Accordingly, rotation of weighted member 88 about a central axis of elongate body 82 translates to rotation of threaded end 90 with respect to threaded portion 76.

Figure 7:
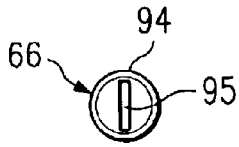
FIG. 7 is an end view of a valve, in accordance with a particular embodiment of the present invention.

As weighted member 88 is rotated, threaded end 90 approaches valve 66, and eventually engages valve 66. Threaded end 90 and valve 66 are provided with corresponding surfaces, such that threaded end 90 can engage valve 66 and rotate valve 66 as weighted member 88 is rotated. For example, valve 66 may be provided with a slot 95 (see FIG. 7) appropriate to receive a standard screwdriver-type head, and threaded end 90 may be provided with such a screwdriver-type head.

As valve 66 moves toward plug 64, reduced diameter neck 70 aligns with detents 39 and 40 to allow detents 39 and 40 to retract with respect to retainer pin 38. With detents 39 and 40 free to slide within cavities 72 and 73, retainer pin 38 may be removed from adapter 30.

Next, weighted member 88 may be used to forcibly disengage retainer pin 38 from adapter 30 and removable tooth 33. Weighted member 88 is then slid rapidly towards enlarged end 92. The operator grips surface 87 and forces weighted member 88 to collide with fixed, enlarged end 92. The force from this collision translates through elongate body 82 and pulls retainer pin 38 toward enlarged end 92. This sliding of weighted member 88 is repeated until retainer pin 38 disengages from removable tooth 33 and adapter 30. The operator can apply additional force to weighted member 88, as necessary to disengage retainer pin 38 from adapter 30. After removing retainer pin 38 from adapter 30, retainer pin 38 may be rotated and disengaged from extraction tool 80.

Each of plugs 64 and 65, and valve 66 include threaded portions configured to cooperate with threaded portions 76 and/or 77 in order to install ore remove such components from retainer pin 38. Accordingly, each of plugs 64 and 65, and valve 66 include a screw-type head similar to screw head 94 shown in FIG. 7.

Screw head 94 also includes at least one groove 95, which is configured to cooperate with a tool to extend or retract the corresponding component to/from the installed position within cylindrical bore 62. Groove 95 may be configured to cooperate with simple hand tools, such as a screwdriver or power drill head. Accordingly, groove 95 may include a standard or Phillips head-type screw receptacle. In other embodiments, groove 95 may comprise a protrusion configured to cooperate with tools other than those described above. For example, screw head 94 may include a fastener head configuration in order to cooperate with various hand or power (impact) wrenches. The specific configuration of screw head 94 may vary significantly within the teachings of the present invention. The configuration is generally selected to cooperate with one or more hand or power tools to allow for the installation or removal of secondary retainer pin 38 from cylindrical bore 62.

In order to install removable tooth 33 upon adapter 30, recess 50 of removable tooth 33 is aligned with second end 36 of adapter 30, and removable tooth 33 is placed over second end 36. Openings 52 and 53 of sides 46 and 48, respectively, are each aligned with internal bore 44. Retainer pin 38 is inserted through opening 52, internal bore 44, and at least partially into opening 53. In its installed position, retainer pin 38 extends from internal bore 44 at least partially into each of openings 52 and 53.

When retainer pin 38 is inserted through internal bore 44, plugs 64 and 65, spring 68, and valve 66 are already in place within cylindrical bore 62. Valve 66 is already positioned such that detents 39 and 40 are aligned with reduced diameter neck 70, and generally retracted with respect to the outer surface of valve 66. Tool 80 is used to retract valve 66 away from plug 64 until detents 39 and 40 are forced to an extended position and contact valve 66 at a surface away from reduced diameter neck, which maintains detents 39 and 40 at least partially within notched openings 78 and 79. Finally, plug 65 may be installed to protect components disposed within cylindrical bore 62 from dirt, debris and/or fluids encountered during use.

The teachings of the present invention may be used for coupling various excavation, earth moving, and/or mining equipment components. In general, any removable and/or replaceable component will benefit from the fastening and component cooperation techniques disclosed herein. More specifically, removable adapters may be coupled with tooth horns of buckets, shovels, or practically any heavy equipment components in accordance with the present invention. Similarly, ripper shanks may be coupled with various removable components provided to protect the ripper shank and/or prolong the life of the ripper shank. Another example of excavation equipment incorporating aspects of the present invention is described with regard to FIG. 8.

Figure 8:
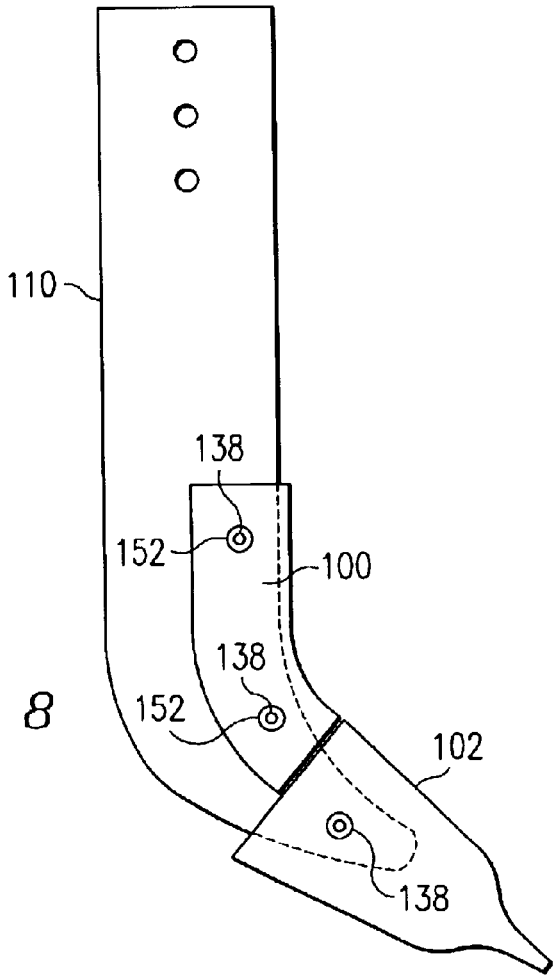
FIG. 8 is a side view of a ripper shank coupled with a removable tooth, and shroud, in accordance with a particular embodiment of the present invention.

FIG. 8 illustrates a shroud 100 coupled with a shank 110 of an excavating machine part. Shank 110 may be referred to as a "ripper shank." For the purposes of this specification, a shank is a type of adapter which may be coupled with various excavation equipment components, and may receive one or more removable teeth. Shroud 100 provides protection to shank 110 when the excavating machine is in use. The excavating machine may be a dragline used in mining operations or any other machine used for excavating purposes. Shroud 100 is coupled with shank 110 using retainer pins 138, which are similar in configuration to retainer pin 38 of FIG. 1. Accordingly, fastening components similar to the retainer pin and related components assemblies described herein may be used to couple shroud 100 with shank 110. Similarly, such retainer pins may be used to couple shank 110 with the excavation equipment component.

Retainer pins 138 may be inserted through openings 152, into an internal bore through shank 110, and extend at least partially into openings 152 formed in shroud 100. A plug, detent, spring and plug system like those described above, may be used to secure retainer pin 138 within shroud 100, to prevent lateral movement of retainer pins 138. Removable tooth 102 is coupled with shank 110 using retainer pin 138. For purposes of this specification, shroud 100 may be considered a removable tooth, which protects one end of shank 110. As discussed above, the teachings of the present invention may be used to removably couple practically any components. Removable tooth 33, adapter 30, shank 110, shroud 100 and tooth 102 are described and shown herein, for illustrative purposes.

Shroud 100 and tooth 102 are used to protect shank 110 from the abrasive environment encountered during excavation. Accordingly, shroud 100 is placed at a location upon shank 110 where significant wear and tear is anticipated. By providing a removable shroud 100 and removable tooth 102, wear and degradation of shank 110 is reduced, thereby increasing its overall service life.

Although embodiments of the invention and their advantages are described in detail, a person skilled in the art could make various alterations, additions, and omissions without departing from the spirit and scope of the present invention as defined by the appended claims.

What is claimed is:

1. A system for coupling excavation equipment components, comprising:

an elongate, retainer pin body defining a cylindrical bore extending at least partially through the retainer pin body;

an elongate, generally cylindrical valve configured to be received at least partially within the cylindrical bore;

at least one detent extending at least partially through a slot in the retainer pin body, the slot being generally perpendicular to the cylindrical bore and extending from the cylindrical bore to an outer surface of the retainer pin body;

the valve having a first position in which the valve contacts the at least one detent and the at least one detent extends beyond the outer surface of the retainer pin body, and a second position in which the at least one detent is retracted with respect to the first position; and a biasing element disposed within the cylindrical bore, the biasing element exerting a force on the first end of the valve.

2. The system of claim 1, wherein the valve includes a first portion having a first diameter, and a slotted portion configured to receive the at least one detent at least partially therein, and wherein the at least one detent contacts the valve at the first portion when the valve is in the first position and the at least one detent is at least partially received within the slotted portion when the valve is in the second position.

3. The system of claim 2, wherein the slotted portion comprises a neck extending generally axially around the outer surface of the valve, the neck having a second diameter which is reduced with respect to the first diameter.

4. The system of claim 1, wherein the biasing element contacts the first end of the valve.

5. The system of claim 1, further comprising, a first plug disposed within the cylindrical bore at a first end of the retainer pin body, wherein the biasing element is disposed between the first end of the valve and the first plug.

6. The system of claim 5, wherein the first plug is threaded along a surface adjacent the retainer pin body such that the plug may be removably coupled with the retainer pin body.

7. The system of claim 2 wherein the at least one detent comprises a first detent, the slotted portion comprises a first slotted portion, and the slot comprises a first slot, and further comprising:

a second detent, extending at least partially through a second slot in the retainer pin body, the second slot being generally perpendicular to the cylindrical bore and extending from the cylindrical bore to the outer surface of the retainer pin body at a location opposite the first slot;

the valve having at least a second slotted portion configured to receive the second detent at least partially therein, and wherein the second detent contacts the valve at the first portion when the valve is in the first position and the detent is at least partially received within the second slotted portion when the valve is in the second position.

8. The system of claim 7, wherein the first and second slotted portions define at least a portion of a reduced diameter neck extending generally axially around the surface of the valve.

9. The system of claim 5, wherein a second end of the valve includes a first threaded portion corresponding to a second threaded portion proximate a second end of the retainer pin body, such that the valve may be moved with respect to the retainer pin body from the first position to the second position by rotating the valve in a first direction.

10. The system of claim 9, further comprising a second plug disposed within the cylindrical bore proximate the second end of the retainer pin body, the second plug including a third threaded portion corresponding to the second threaded portion at the second end of the retainer pin body such that the second plug may be removably coupled with the retainer pin body.

11. The system of claim 1, further comprising:

an adapter having first and second tapered surfaces, and first and second sides, the first and second tapered surfaces converging toward a first end of the adapter;

the adapter defining an internal bore which extends from the first side of the adapter and at least partially through the adapter;

the internal bore being configured to receive the retainer pin body at least partially therein;

the at least one detent being operable to couple the adapter and the retainer pin body and prevent movement of the retainer pin body with respect to the adapter when the valve is in the first position.

12. The system of claim 11, wherein the first and second ends of the retainer pin body extend beyond first and second sides of the adapter, and further comprising:

a tooth point being coupled with the adapter proximate the first end of the adapter, the tooth point having a contact edge opposite the first end of the adapter;

first and second sides of the tooth point being adjacent the first and second sides of the adapter, respectively, defining first and second cavities, respectively, the first and second cavities each being configured to receive the retainer pin; and wherein the retainer pin forms the coupling between the tooth point and the adapter.

* * * * *